US007090587B2

(12) United States Patent
Kim

(10) Patent No.: US 7,090,587 B2
(45) Date of Patent: Aug. 15, 2006

(54) APPARATUS FOR COMBINED GAME OF BOWLING AND BILLIARDS

(75) Inventor: Jeong Ho Kim, Youngjoo (KR)

(73) Assignee: Byung Sun Min, (KR)

( * ) Notice: Subject to any disclaimer, the term of this patent is extended or adjusted under 35 U.S.C. 154(b) by 306 days.

(21) Appl. No.: 10/441,350

(22) Filed: May 20, 2003

(65) Prior Publication Data

US 2003/0220147 A1 Nov. 27, 2003

(30) Foreign Application Priority Data

May 21, 2002 (KR) ..... 10-2002-0028150

(51) Int. Cl.
*A63D 1/08* (2006.01)

(52) U.S. Cl. ..... 473/116; 473/110; 473/96; 473/99; 473/90

(58) Field of Classification Search ..... 473/73, 473/89, 90, 91, 94–99, 106, 110, 111
See application file for complete search history.

(56) References Cited

U.S. PATENT DOCUMENTS 2,450,249 A * 9/1948 Murphy ..... 473/90
2,670,205 A * 2/1954 Sherman ..... 473/90
2,821,395 A * 1/1958 Dumas ..... 473/90
3,526,401 A * 9/1970 Zuercher ..... 473/96
3,807,732 A * 4/1974 Congelli ..... 473/91
3,880,425 A * 4/1975 Kintz ..... 473/116
5,868,629 A * 2/1999 VanDuyn et al. ..... 473/111

* cited by examiner

*Primary Examiner*—William M. Pierce
(74) *Attorney, Agent, or Firm*—Cantor Colburn LLP

(57) ABSTRACT

Disclosed is an apparatus for a billiard bowling game. The apparatus includes a bowling pin distributing section and a bowling ball returning section. The bowling pin distributing section is constructed such that, while bowling pin distributing means is driven by driving means, respective bowling pins transferred from bowling pin collecting means are sequentially set in bowling pin setting holes defined in a bowling pin setting plate. The bowling ball returning section is constructed such that the bowling ball rolling on a sloped plate which is fastened to a fixed plate of a base section is raised between a curved inner edge of a bowling ball-guiding curved plate and a bowling ball-driving wheel fitted around a driving shaft and between inner surfaces of a pair of side plates, so as to be placed at an entrance to bowling ball returning rails.

14 Claims, 13 Drawing Sheets

【Fig 1】
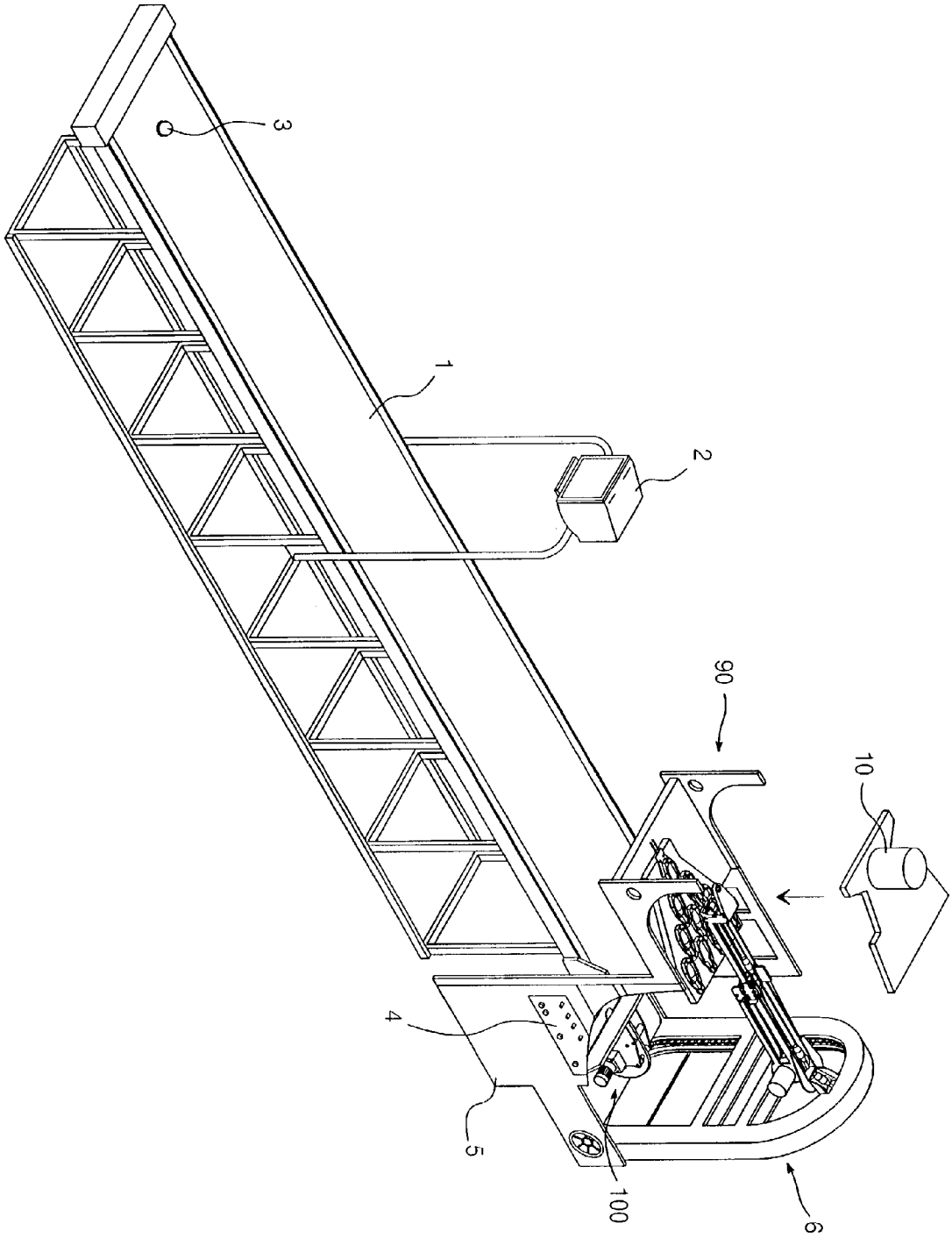

【Fig 2】
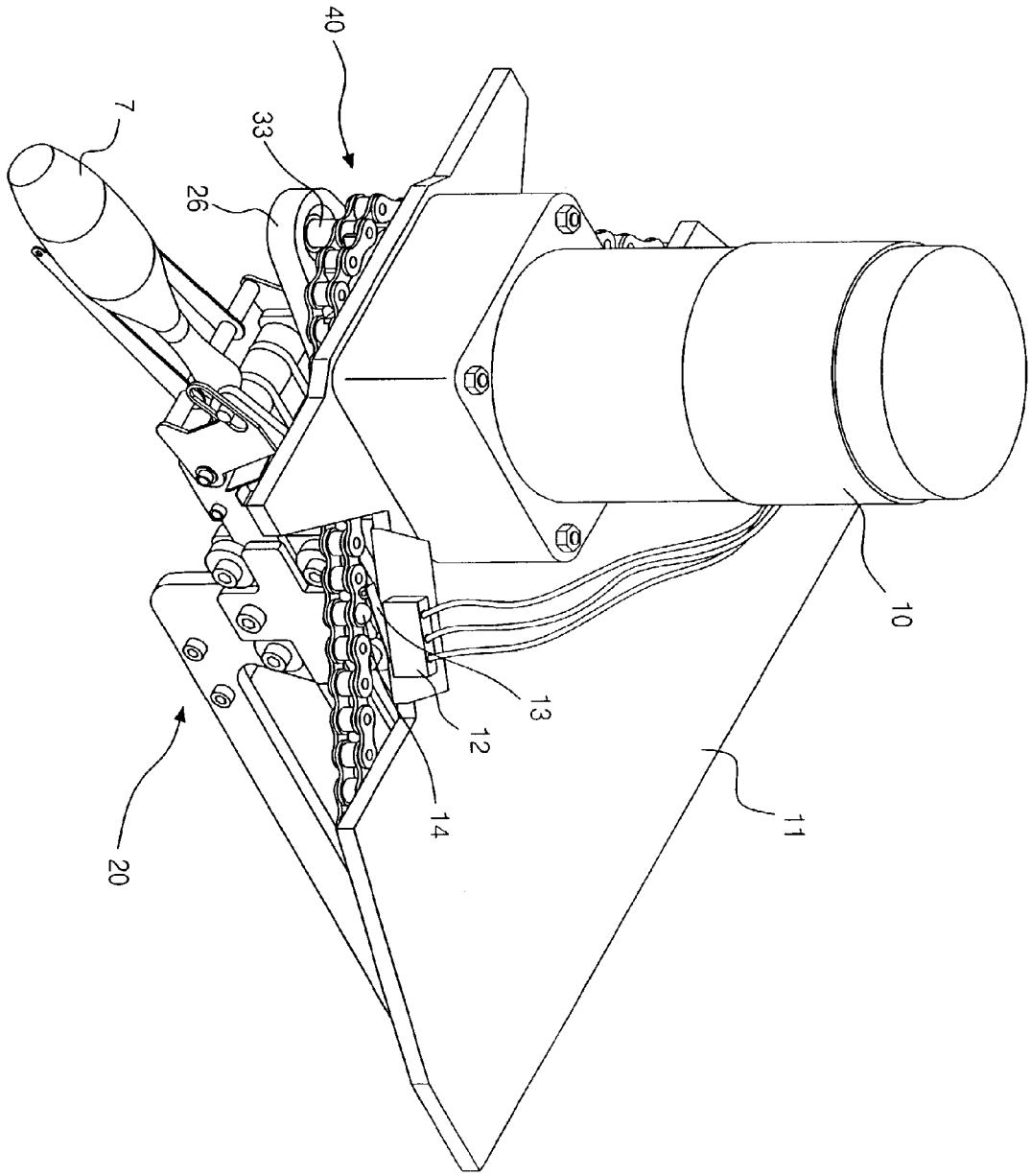

【Fig 3】
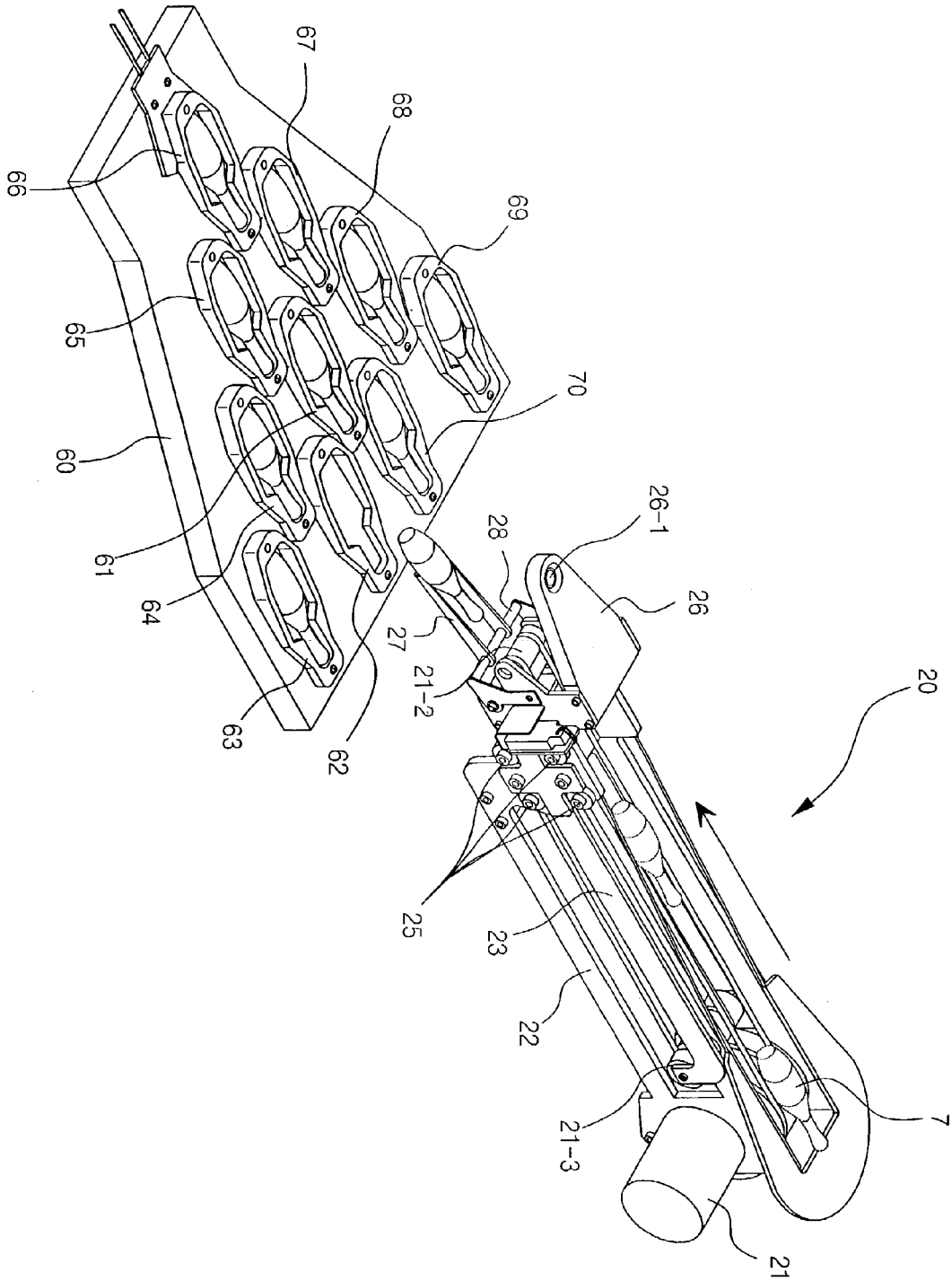

【Fig 4】
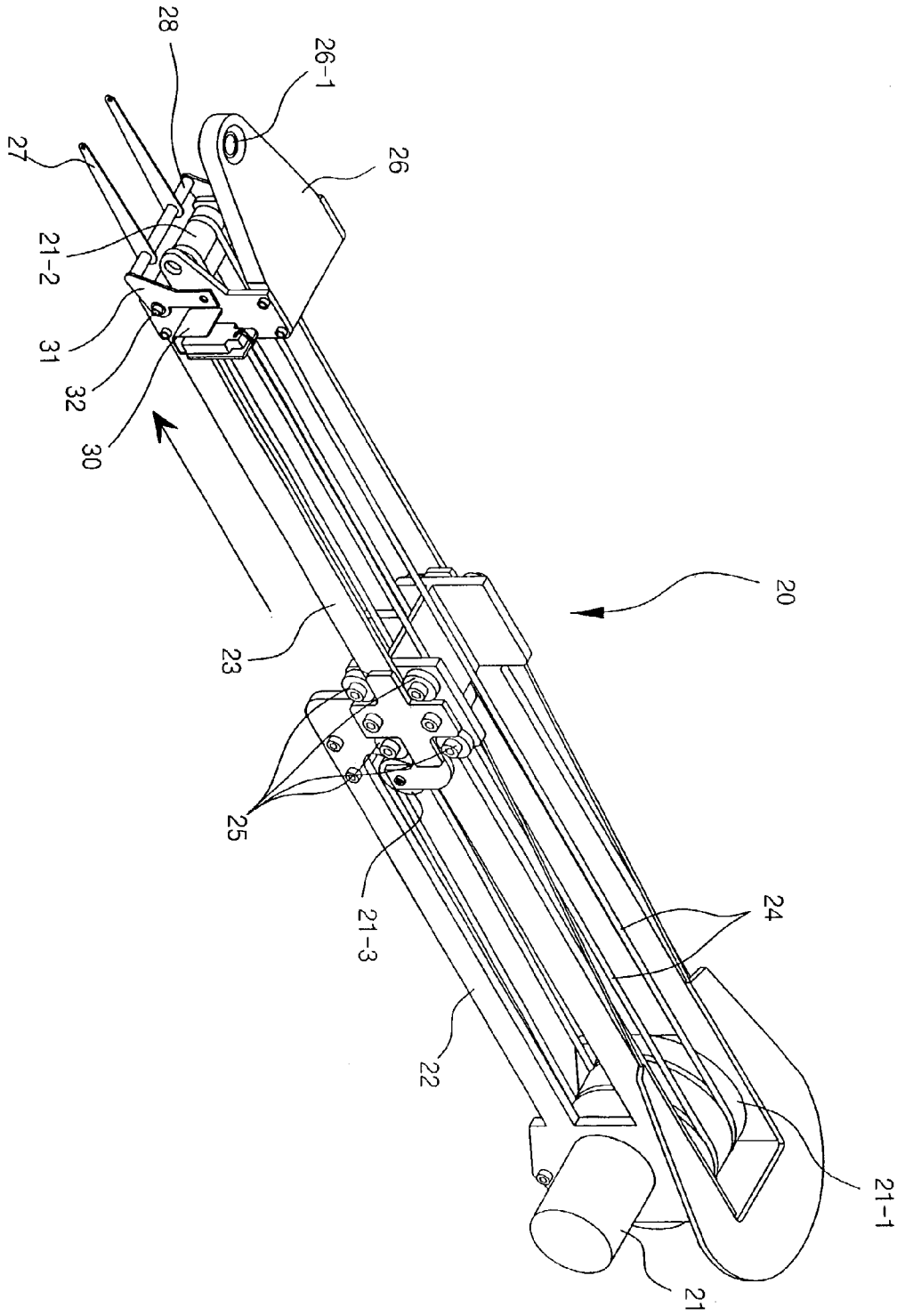

【Fig 5】
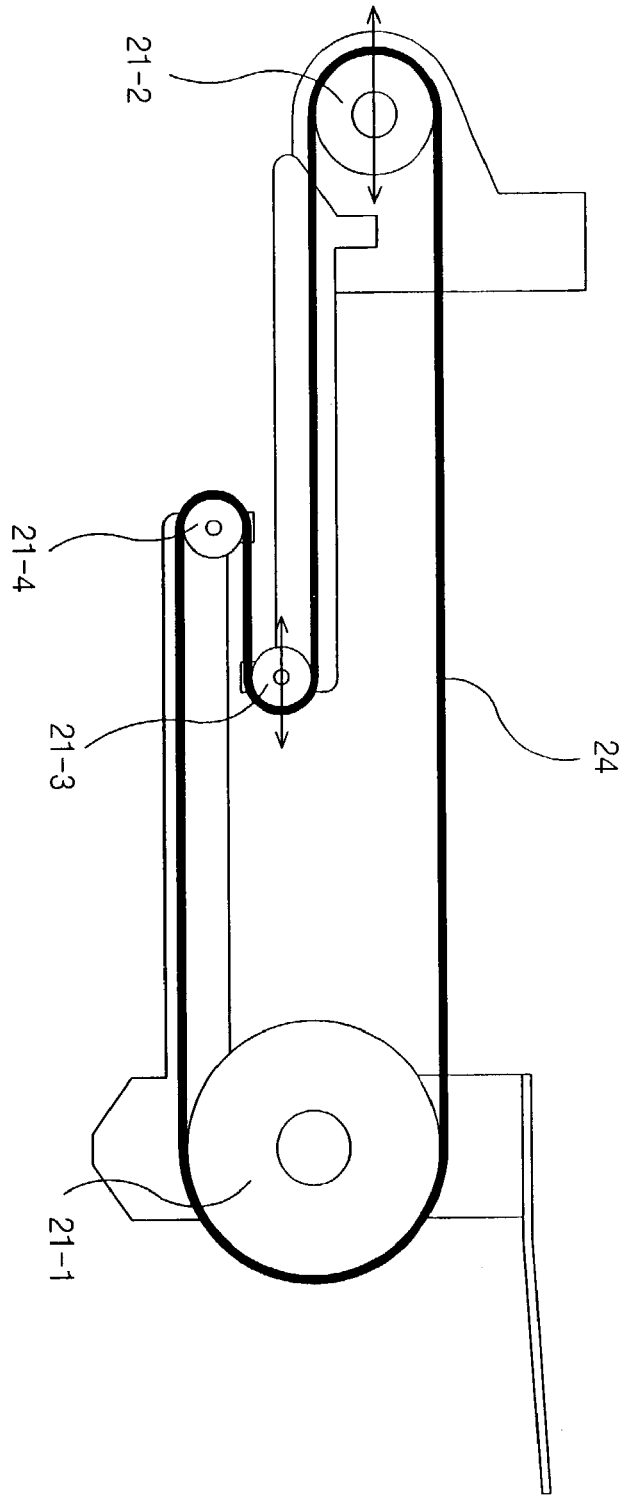

【Fig 6】
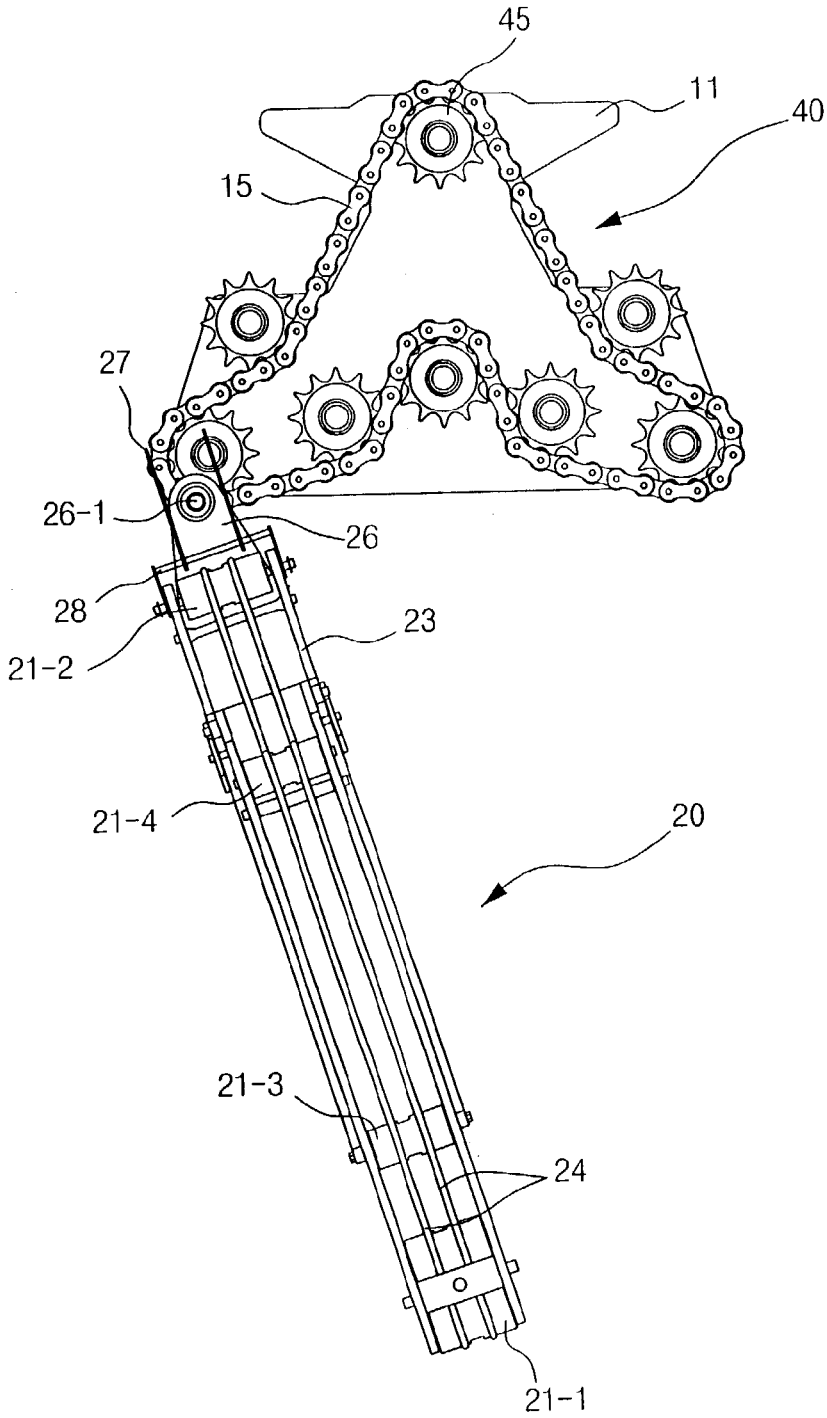

【Fig 7】
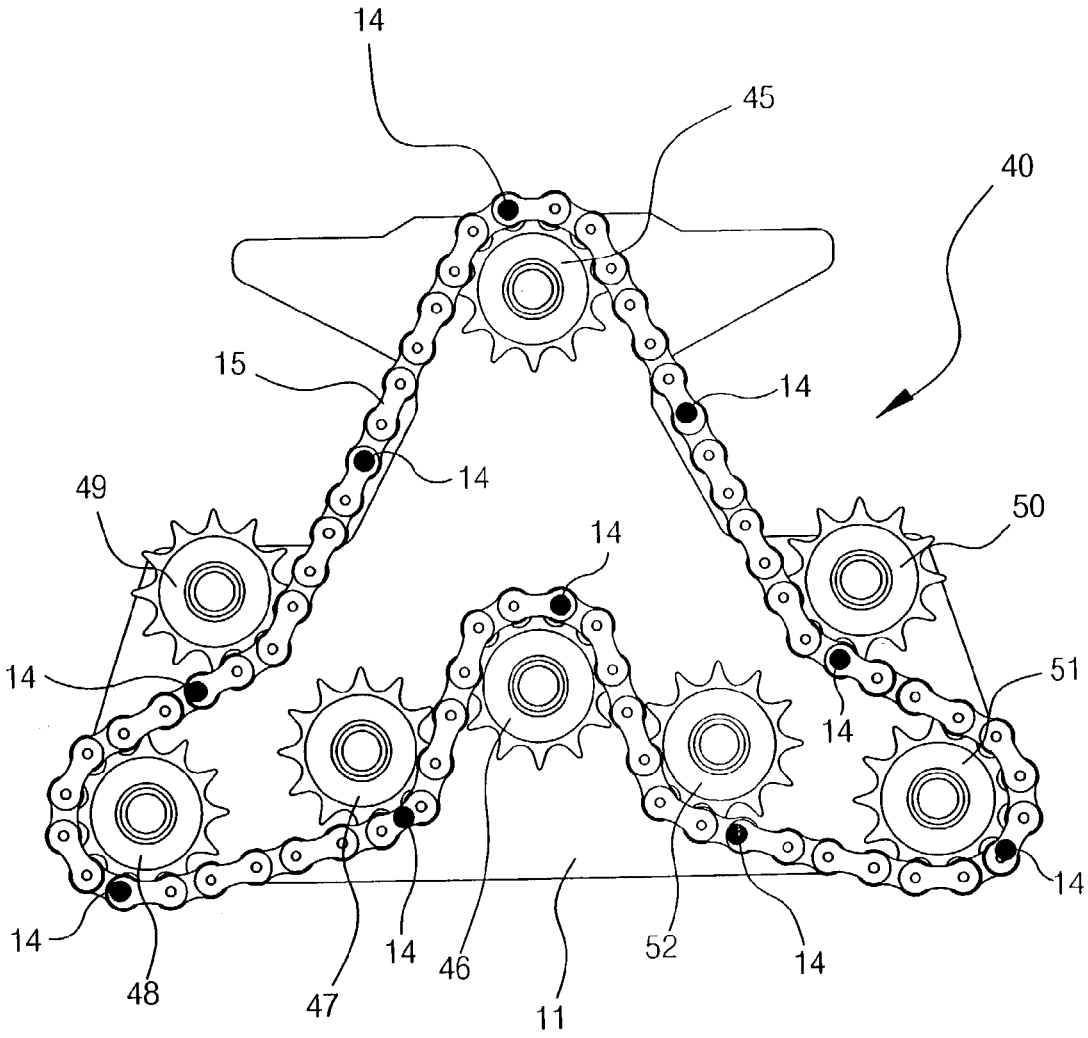

【Fig 8】
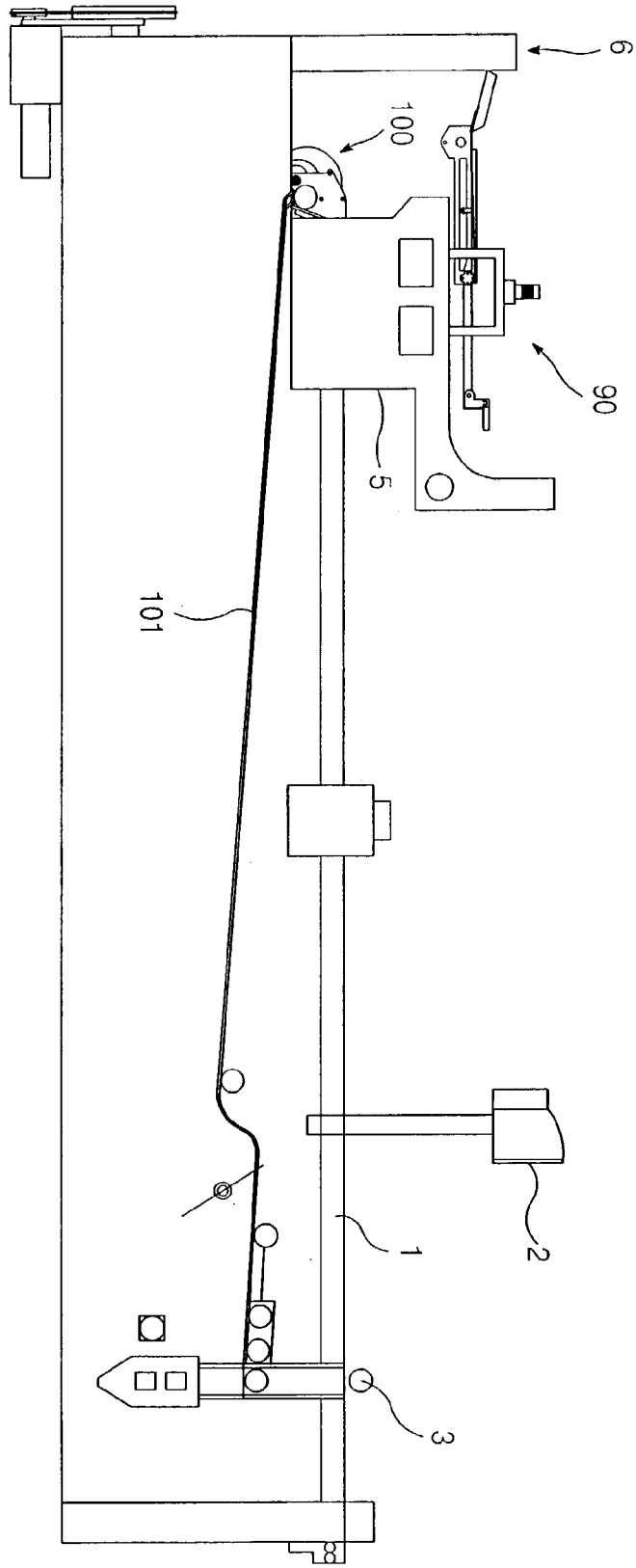

【Fig 9】
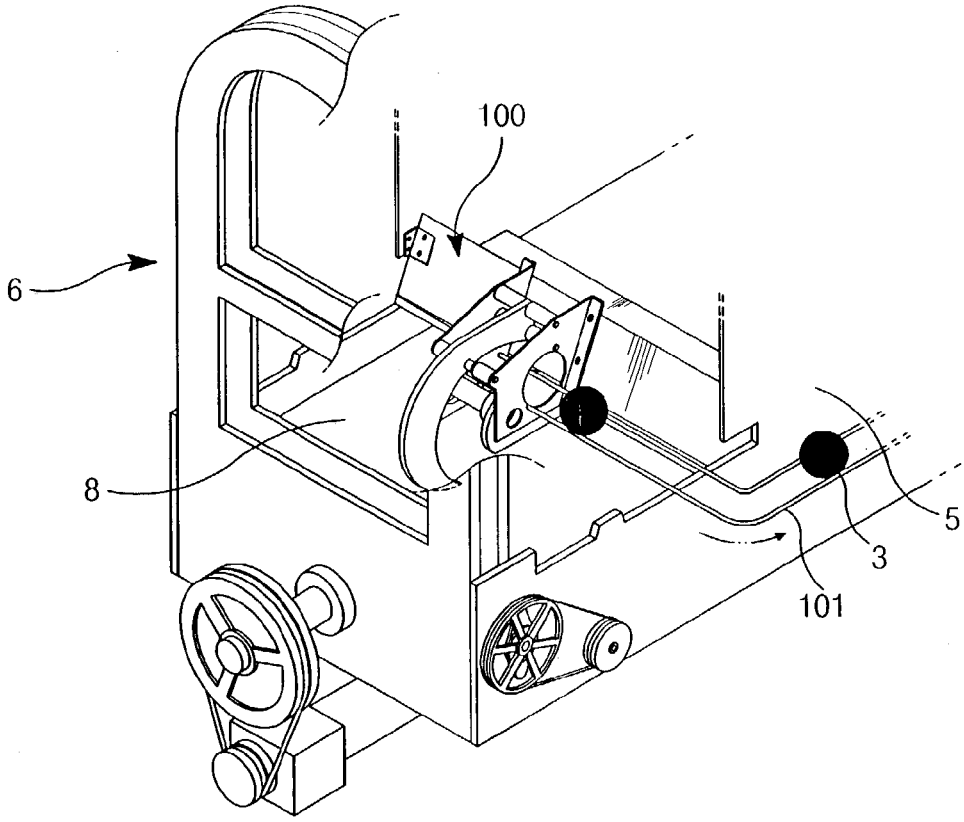

【Fig 10】
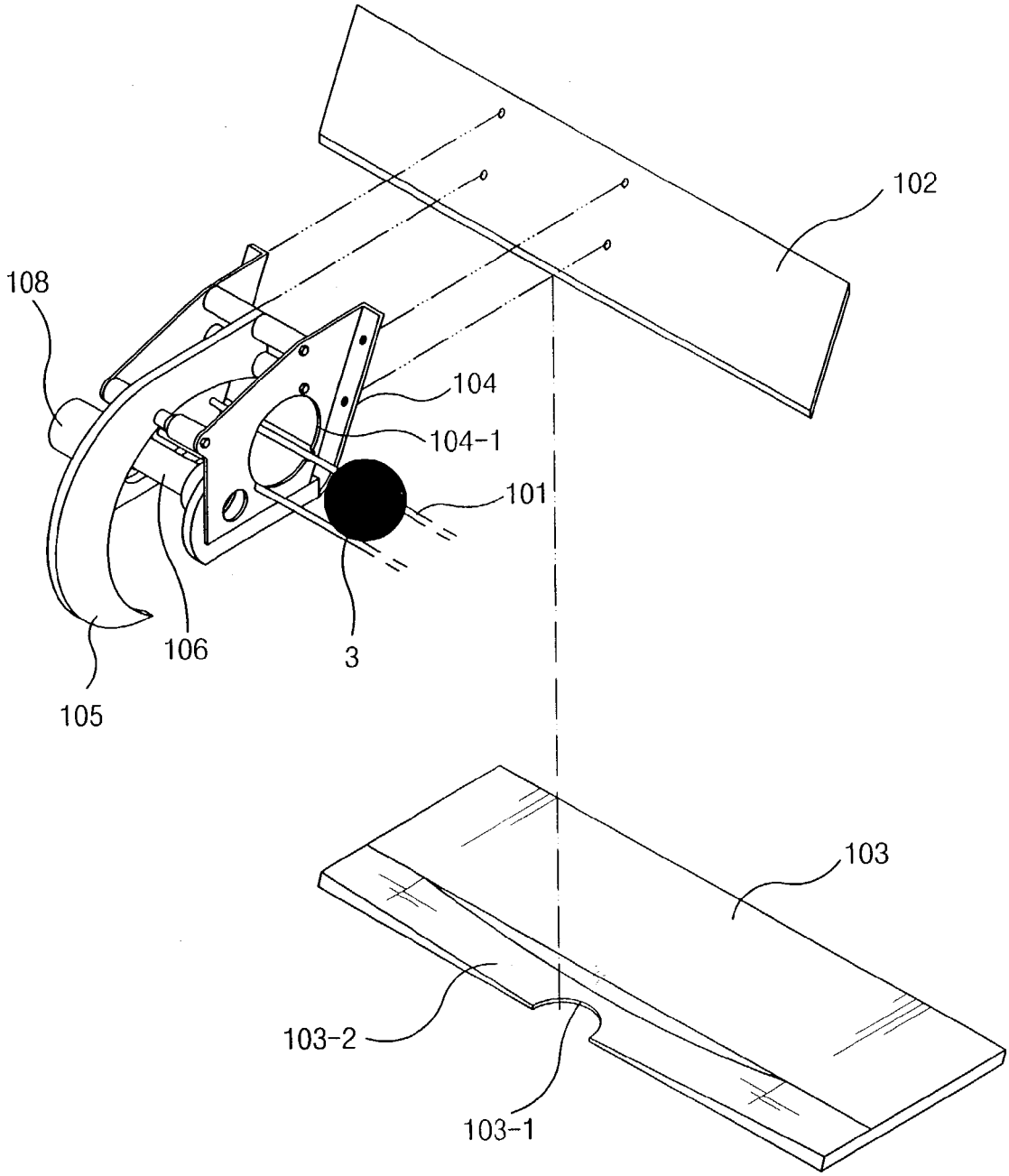

【Fig 11】
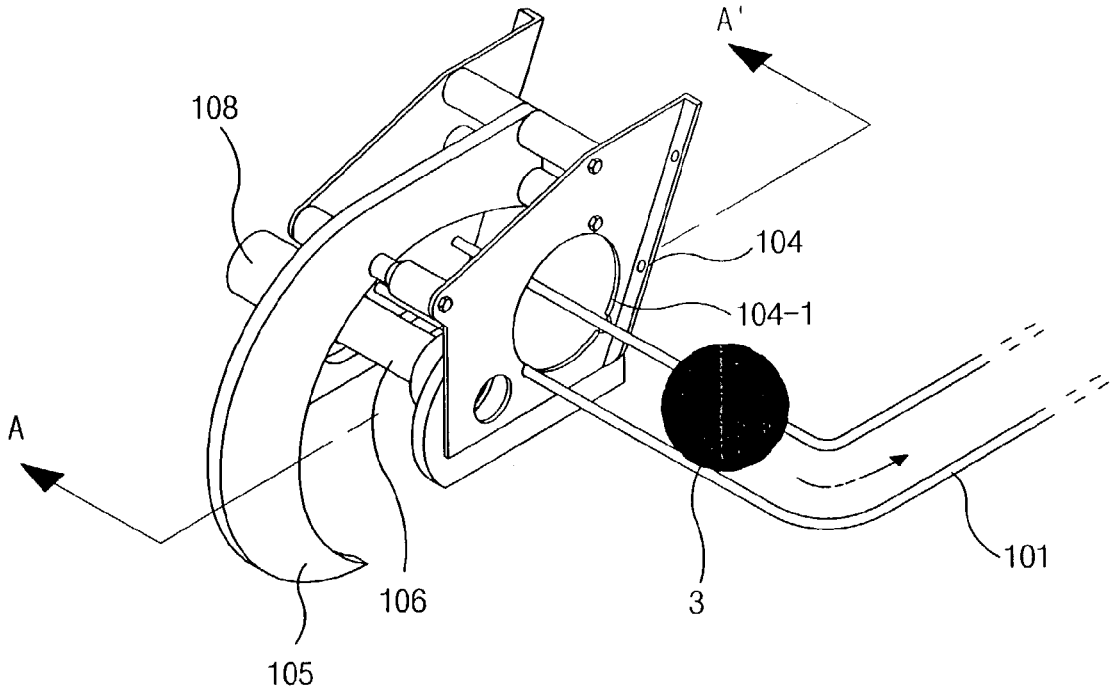

【Fig 12】
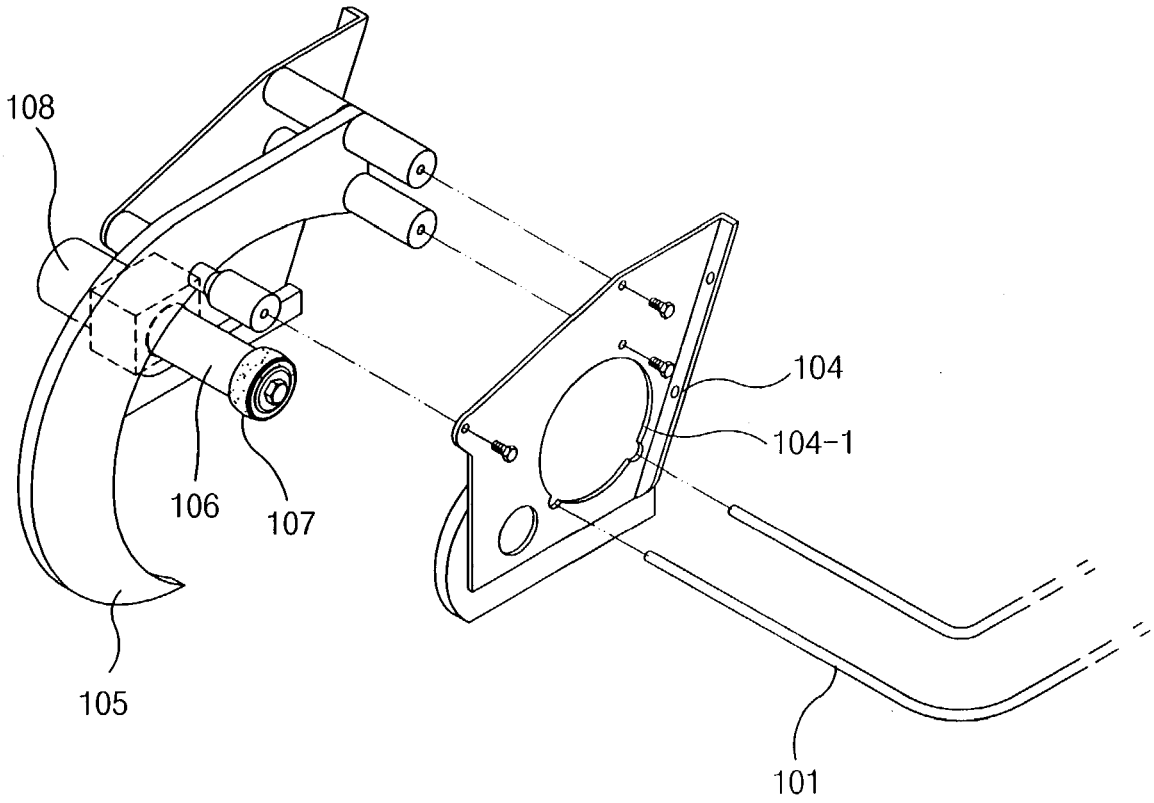

【Fig 13】
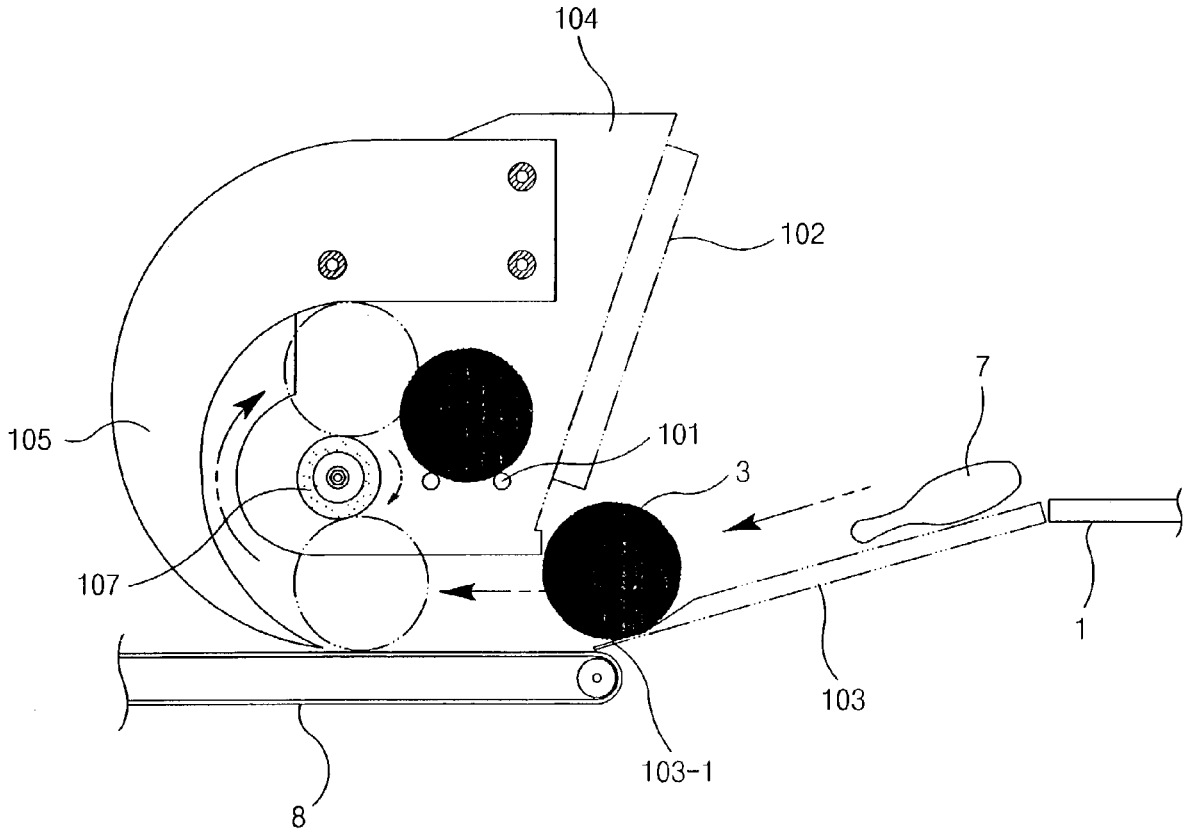

APPARATUS FOR COMBINED GAME OF BOWLING AND BILLIARDS

BACKGROUND OF THE INVENTION

1. Field of the Invention

The present invention relates, in general, to an apparatus for a combined game of bowling and billiards (hereinafter, referred to as "billiard bowling game"), which utilizes both billiard skills and bowling skills, and, more particularly, to an apparatus for a billiard bowling game in which a miniature bowling ball is struck and driven by a billiard cue to knock down bowling pins, wherein the apparatus is constructed to distribute bowling pins so as to automatically set the bowling pins on a bowling lane and at the same time to return the bowling ball by causing a free-falling motion of the bowling ball.

2. Description of the Prior Art

As well known to those skilled in the art, in a billiard bowling game, a billiard cue is used to strike and drive a miniature bowling ball which is scaled down to the size of a billiard ball. Then, the bowling ball rolls on a bowling lane to knock down all of ten bowling pins which are set on an opposite end of the bowling lane. A score is calculated depending upon the number of fallen pins, and a person who acquires a highest score wins the game.

Therefore, the billiard bowling game has substantially the same pattern of play as a bowling game, except that the bowling ball is struck and driven by the billiard cue rather than being grasped and thrown by the hand.

Accordingly, in the conventional billiard bowling game, a bowling ball returning section for returning a used bowling ball to its original ready-for-use position and a bowling pin distributing section for distributing bowling pins with an aim of resetting collected bowling pins on a bowling lane are structured in the same manner as those in the bowling game.

However, in the case that the bowling ball returning section and bowling pin distributing section, which are adopted in the bowling game, are adopted in the billiard bowling game as they are, problems are caused in that their structures are complicated, precision, repeatability and rapidity of bowling ball returning and bowling pin distributing operations are poor, and an excessive manufacturing cost is required, thereby deteriorating popularity of the billiard bowling game.

SUMMARY OF THE INVENTION

Accordingly, the present invention has been made keeping in mind the above problems occurring in the prior art, and an object of the present invention is to provide an apparatus for a billiard bowling game, which is constructed in a manner such that, after bowling pins are placed by a bowling pin collecting section on bowling pin delivery belts of a bowling pin distributing section, the respective bowling pins are precisely distributed into bowling pin setting holes defined in a bowling pin setting plate, through driving of a chain, and in a manner such that, after a bowling ball rolling between a fixed plate and a bowling ball-guiding plate is raised along a bowling ball-guiding curved plate, the bowling ball freely falls into sloped returning rails to be returned to its ready-for-use position, whereby precision, repeatability and rapidity of bowling ball returning and bowling pin distributing operations are excellent, and structures for performing the above operations are simplified to thereby increase popularity of the billiard bowling game.

In order to achieve the above object, according to the present invention, there is provided an apparatus for a billiard bowling game in which, when a bowling ball struck and driven by a billiard cue knocks down a plurality of bowling pins erected at an end of a bowling lane, the bowling ball is returned to its ready-for-use position through returning rails and the bowling pins are collected through bowling pin collecting means, the apparatus comprising: a bowling pin distributing section constructed in a manner such that, while bowling pin distributing means is driven by driving means, respective bowling pins transferred from the bowling pin collecting means installed on a base section are sequentially set and distributed in bowling pin setting holes defined in a bowling pin setting plate; and a bowling ball returning section constructed in a manner such that the bowling ball, which is naturally guided along an inclined guide surface and a guide groove of a sloped plate which is fastened to a fixed plate of the base section so as to be positioned above a conveyor, is raised between a curved inner edge of a bowling ball-guiding curved plate and a bowling ball-driving wheel fitted around a driving shaft and between inner surfaces of a pair of side plates, so as to be placed at an entrance to the returning rails.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view illustrating an apparatus for a billiard bowling game in accordance with an embodiment of the present invention;

FIGS. 2 through 4 are perspective views illustrating a bowling pin distributing section according to the present invention;

FIG. 5 is a view for explaining an operation of bowling pin distributing means of the bowling pin distributing section according to the present invention;

FIGS. 6 and 7 are bottom views illustrating the bowling pin distributing section according to the present invention;

FIG. 8 is a side view of the apparatus for a billiard bowling game according to the present invention;

FIG. 9 is a partial perspective view illustrating the apparatus for a billiard bowling game according to the present invention;

FIGS. 10 and 11 are perspective views illustrating a bowling ball collecting section of the apparatus for a billiard bowling game according to the present invention;

FIG. 12 is an exploded perspective view illustrating the bowling ball collecting section of the apparatus for a billiard bowling game according to the present invention; and FIG. 13 is a cross-sectional view taken along the line A–A' of FIG. 11.

DETAILED DESCRIPTION OF THE INVENTION

Reference should now be made to the drawings, in which the same reference numerals are used throughout the different drawings to designate the same or similar components.

As can be readily understood from FIG. 1, if a bowling ball 3 is struck and driven by a billiard cue, the bowling ball 3 rolls on a bowling lane 1 and then knocks down some of bowling pins standing at a rear end of the bowling lane 1, which rear end adjoins a base section 5.

Thereafter, fallen bowling pins are automatically swept away and collected by a bowling pin collecting section 6, separately from the bowling ball 3, and then transferred to a bowling pin distributing section 90 one by one.

The bowling pin distributing section 90 performs a function of setting and distributing ten bowling pins transferred from the bowling pin collecting section 6 in a bowling pin setting plate 60 to allow the ten bowling pins to be erected on the rear end of the bowling lane 1.

A bowling ball returning section 100 is installed between the bowling pin distributing section 90 and the bowling pin collecting section 6. The bowling ball returning section 100 is constructed in a manner such that, after knocking down some of the bowling pins, the bowling ball 3 is separated from the bowling pins and raised by a predetermined height, and then, as shown in FIG. 8, freely falls onto returning rails 101 to be returned to its initial ready-for-use position.

First describing in detail the bowling pin distributing section 90, as shown in FIGS. 2 through 6, the bowling pin distributing section 90 is installed to be positioned above the rear end of the bowling lane 1 on which the bowling pins 7 are erected. The bowling pin distributing section 90 comprises bowling pin distributing means 20, driving means 40 and the bowling pin setting plate 60.

The bowling pin distributing means 20 is driven by the driving means 40 to sequentially set the ten bowling pins 7 transferred from a bowling pin elevator of the bowling pin collecting section 6, in the bowling pin setting plate 60.

To this end, in the bowling pin distributing means 20, a first frame 22 is installed on an upper part of the bowling pin collecting section 6 in such a way as to be capable of being rotated leftward and rightward. Further, a second frame 23 is coupled to the first frame 22 such that the second frame 23 can slide on guide rolls 25 provided to the first frame 22, to be extended forward and retracted backward, whereby an entire length of the first and second frames can be changed.

A driving roller 21-1 which is driven by a second driving motor 21 is installed at a rear end of the first frame 22, and a fixed tension roller 21-4 is installed at a front end of the first frame 22. A driven roller 21-2 is installed at a front end of the second frame 23, and a movable tension roller 21-3 is installed at a rear end of the second frame 23.

A pair of bowling pin delivering belts 24 are wound on the driving roller 21-1, driven roller 21-2, fixed tension roller 21-4 and movable tension roller 21-3 to be driven by the driving roller 21-1 operatively coupled to the second driving motor 21.

Concretely speaking, if the second driving motor 21 drives the driving roller 21-1, the pair of bowling pin delivering belts 24 are rotated while being wound on the driving roller 21-1 and the driven rollers 21-2, to deliver the bowling pins forward.

In order to drive the bowling pin delivering belts 24, a predetermined tension must be applied to the belts 24. In this regard, referring to FIG. 5, it is to be readily understood that, if the second frame 23 is moved forward or backward, while the movable tension roller 21-3 installed at the rear end of the second frame 23 is also moved forward or backward along with the second frame 23, the fixed tension roller 21-4 installed at the front end of the first frame 22 is held fixed to maintain tension of the bowling pin delivering belts 24.

A pair of bowling pin distributing arms 27 are provided to the front end of the second frame 23 and fixedly supported by a support shaft 28. Both ends of the support shaft 28 are fixed to a pair of pivoting plates 31, respectively. The respective pivoting plates 31 are installed on both side walls of the second frame 23 such that the pivoting plates 31 can be elastically pivoted about a center shaft 32.

Concretely speaking, between the pair of pivoting plates 31 which are respectively fixed to left and right ends of the center shaft 32, the left pivoting plate is connected to the left side wall of the second frame 23 via a coil spring (not shown), and the right pivoting plate is constructed to be brought into contact with a limit switch upon being pivoted.

As a consequence, if the bowling pin distributing arms 27 are pressed downward by a weight of the bowling pin 7 placed thereon, the pivoting plates 31 are elastically pivoted downward about the center shaft 32 to be detached from the limit switch 30, and if the bowling pin 7 placed on the bowling pin distributing arms 27 is set and distributed in one of bowling pin setting holes 61 through 70 which are defined in the bowling pin setting plate 60, the pivoting plates 31 are returned to their original position due to elastic force of the coil spring, to be brought into contact with the limit switch 30.

At this time, the limit switch 30 brought into contact with the pivoting plates 31 generates an electrical signal to drive the first driving motor 10.

Accordingly, if the bowling pin 7 which is delivered by the bowling pin delivering belts 24 falls onto the bowling pin distributing arms 27, the bowling pin distributing arms 27 are pivoted downward by the weight of the bowling pin 7 to be held inclined and thereby smoothly guide the bowling pin into the corresponding one of the bowling pin setting holes 61 through 70. Thereafter, the bowling pin distributing arms 27 are pivoted upward due to elasticity of the pivoting plates 31 to be returned to their original position.

In the meanwhile, as shown in FIGS. 7 and 8, the driving means 40, which is installed on the bowling pin distributing means 20, has a support plate 11 which is fixedly installed adjacent to an upper end of the base section 5. A driving sprocket 45 and seven driven sprockets 46 through 52 are mounted on a lower surface of the support plate 11.

The chain 15, which is wound on the driving sprocket 45 and the driven sprockets 46 through 52, is provided with ten projections 14 which are spaced apart one from another by a constant distance.

In the driving means 40 of the present invention, as can be readily seen from FIG. 2, the first driving motor 10 is installed on the support plate 11, and a driving shaft of the first-driving motor 10 passes through the support plate 11 to drive the driving sprocket 45.

A sensor box 12 is fixedly attached to a side of the support plate 11 and provided on a lower surface thereof with a limit switch 13. If the projection 14 of the chain 15 is brought into contact with the limit switch 13, the corresponding situation is sensed by the sensor box 12 to interrupt the operation of the first driving motor 10, by which movement of the chain 15 driven by the driving sprocket 45 is ceased.

A link plate 26 which is defined with a pin hole 26-1 is fixedly mounted to the front end of the second frame 23. If a link pin 33 is inserted into the pin hole 26-1, the link plate 26 is rigidly connected with the chain 15. By this fact, if the chain 15 is driven, the bowling pin distributing section 20 is also driven in an interlocked manner with the chain 15.

In the present invention, as shown in FIG. 3, the bowling pin setting plate 60 is installed to be placed underneath the bowling pin distributing means 20. The bowling pin setting plate 60 is defined with ten bowling pin setting holes 61 through 70.

Meanwhile, as shown in FIGS. 1, 8 and 9, the bowling ball returning section 100 according to the present invention is installed between the base section 5 and the bowling pin collecting section 6. The bowling ball returning section 100 includes a sloped plate 103 which is arranged below a fixed plate 102 constituting the base section 5 to be connected to the rear end of the bowling lane 1. The sloped plate 103 is defined with an inclined guide surface 103-2 and a guide groove 103-1. The bowling ball returning section 100 is constructed in a manner such that the bowling ball 3, which is naturally guided along the inclined guide surface 103-2 and into guide groove 103-1 of the sloped plate 103, is raised along a curved inner edge of a bowling ball-guiding curved plate 105, and then freely falls into the bowling ball returning rails 101 to be returned to its ready-for-use position.

Concretely speaking, in the bowling ball returning section 100, as shown in FIGS. 10 through 12, a pair of side plates 104 are fastened to the fixed plate 102 adjacent to a rear lower end of the base section 5. The bowling ball-guiding curved plate 105 is installed between the pair of side plates 104. A driving motor 108 is fixedly mounted to one of the side plates 104, and a driving shaft 106 of the driving motor 108 is installed to pass through a center axis of the bowling ball-guiding curved plate 105, which has a semi-circular configuration.

A bowling ball-driving wheel 107 made of rubber is fitted around a free end of the driving shaft 106. If the driving shaft 106 is driven by the driving motor 108, the bowling ball-driving wheel 107 is brought into contact with an outer surface of the bowling ball 3 which is guided directly below the bowling ball-guiding curved plate 105.

At this time, as the bowling ball-driving wheel 107 is rubbed with the outer surface of the bowling ball 3, the bowling ball-driving wheel 107 pushes upward the bowling ball 3 along the curved inner edge of the bowling ball-guiding curved plate 105. By this fact, the bowling ball 3 is raised between the curved inner edge of the bowling ball-guiding curved plate 105 and the bowling ball-driving wheel 107 and between inner surfaces of the pair of side plates 104, so as to be placed at an entrance to the bowling ball returning rails 101.

The bowling ball 3 placed at the entrance to the returning rails 101 freely falls through a bowling ball discharge opening 104-1 defined in the other side plate 104, due to downward inclination of the returning rails 101, and then rolls through the returning rails 101 toward an exit of the returning rails 101 to be returned to its ready-for-use position.

Hereinafter, working effects of the apparatus for a billiard bowling game according to the present invention, constructed as mentioned above, will be described.

First, if the bowling ball 3 positioned at a front end of the bowling lane 1 is struck and driven by the billiard cue, the bowling ball 3 rolls on the bowling lane 1 and then knocks down some of ten bowling pins 7 standing at the rear end of the bowling lane 1.

At this time, the bowling ball 3 and the fallen bowling pins 7 roll on a sloped surface of the sloped plate 103. The bowling pins 7 are discharged through a space defined between the fixed plate 102 and the sloped plate 103 to be delivered to a lower part of the bowling pin collecting section 6 by a conveyor 8 which is arranged below the bowling ball returning section 100. The bowling ball 3 is not discharged through the space defined between the fixed plate 102 and the sloped plate 103, and instead, is guided along the inclined guide surface 103-2 into the guide groove 103-1.

Then, the bowling ball 3 which is discharged through the guide groove 103-1 of the sloped plate 103 is naturally guided between lower parts of the side plates 104. Then, as the bowling ball-driving wheel 107 is driven, the bowling ball 3 is pushed upward along the curved inner edge of the bowling ball-guiding curved plate 105 to be placed at the entrance to the returning rails 101.

The bowling ball 3 placed at the entrance to the returning rails 101 rolls through the bowling ball discharge opening 104-1 defined through the other side plate 104, toward the front end of the bowling lane 1, due to inclination of the returning rails 101.

When conducting the bowling pin distributing operation, if the first and second driving motors 10 and 21 are actuated through manipulation on a manipulating plate 4 of the base section 5, the chain 15 is driven by the driving sprocket 45. By this fact, as the driving roller 21-1 is driven, the bowling pin delivering belts 24 are also driven to deliver forward the bowling pin 7 transferred from the bowling pin collecting section 6.

At this time, when the chain 15 is driven, if the bowling pin distributing arms 27 of the bowling pin distributing means 20 are positioned above the first bowling pin setting hole 61, the corresponding projection 14 is brought into contact with the limit switch 13, by which the sensor box 12 outputs a signal to interrupt the operation of the first driving motor 10 for a predetermined time.

At the same time, if the bowling pin 7 which is delivered by the bowling pin delivering belts 24 is seated on the bowling pin distributing arms 27, as the bowling pin distributing arms 27 are pivoted downward by the weight of the bowling pin 7, the pivoting plates 31 are instantaneously detached from the limit switch 30. Thereafter, if the bowling pin 7 seated on the bowling pin distributing arms 27 is set in the first bowling pin setting hole 61, as the pivoting plates 31 are returned to their original position by the elastic force of the coil spring, the pivoting plates 31 are again brought into contact with the limit switch 30.

Thereupon, the limit switch 30 generates an electrical signal to drive again the first driving motor 10. As the first driving motor 10 is operated, the chain 15 is rotated. Thereafter, as the bowling pin distributing arms 27 of the bowling pin distributing means 20 is positioned directly above the second bowling pin setting hole 62, the corresponding projection 14 is brought into contact with the limit switch 13, whereby the limit switch 13 outputs a signal for interrupting the operation of the first driving motor 10 for the predetermined time.

In the same way, if the bowling pin 7 which is delivered by the bowling pin delivering belts 24 is set in the tenth bowling pin setting hole 70, one cycle of the bowling pin distributing operation is completed, and in succession, the bowling pin distributing operation is restarted from the first bowling pin setting hole 61.

As apparent from the above description, the present invention provides advantages in that precision, repeatability and rapidity of bowling pin distributing and bowling ball returning operations are excellent, and structures for performing the operations are simplified to thereby increase popularity of the billiard bowling game.

Therefore, the present invention provides an apparatus for a billiard bowling game which utilizes both billiard skills and bowling skills and is adapted to be played in a limited space. In particular, the apparatus performs bowling pin distributing and bowling ball returning operations in an excellent manner. Further, since a manufacturing cost of the apparatus is reduced, popularity of the billiard bowling game as a table type game can be increased.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for a billiard bowling game comprising:

a bowling pin collection section;

a conveyor to forward knocked down bowling pins to the bowling pin collection section;

a bowling pin distributing section in communication with the bowling pin collection section, the bowling pin distributing section including:

a bowling pin distributing means for sequentially setting and distributing bowling pins;

a driving means for driving the bowling pin distributing mean to transfer respective bowling pins from the bowling pin collecting means;

a base section having bowling pin setting holes defined in a bowling pin setting plate for sequentially receiving bowling pins in respective bowling pin setting holes; and a bowling ball returning section intermediate the base section and the bowling pin collection section, the bowling ball returning section including;

a sloped plate having an inclined guide surface, the sloped plate having a guide groove disposed below a fixed plate defining the base section and positioned above the conveyor and between a pair of side plates fastened to the fixed plate and adjacent to a rear lower end of the base section;

a pair of returning rails extending from an opening in one of the side plates;

a bowling ball-guiding curved plate installed between the pair of side plates;

a driving motor fixedly mounted to one of the side plates; and a driving shaft of the driving motor installed to pass through a center axis of the bowling ball-guiding curved plate having a semi-circular configuration, wherein when a bowling ball is struck and driven by a billiard cue knocks down at least one of the plurality of bowling pins erected at an end of a bowling lane, the bowling ball is returned to its ready-for-use position through the returning rails and the at least one bowling pin is collected through the bowling pin collecting means.

2. The apparatus according to claim 1, wherein the driving means includes a chain wound on a driving sprocket coupled to a fist driving motor and a plurality of driven sprockets, and a plurality of intermittent spaced-apart projections extending from the chain to interrupt operation of the first driving motor when a projection of the plurality of the projections is brought into contact with a limit switch operably connected to the first driving motor.

3. The apparatus according to claim 2, wherein the bowling pin distributing means includes a first frame rotating leftward or rightward by the chain, a second frame extending forward or retracting backward on guide rolls, a pair of bowling pin delivering belts driven by a second driving motor to deliver respective bowling pins transferred from the bowling pin collecting section, a pair of bowling pin distributing arms elastically pivoted with a pivoting plate to sequentially set and distribute the respective bowling pins in the bowling pin setting holes defined in the bowling pin setting plate.

4. The apparatus according to claim 3, wherein the operation of the first driving motor is controlled by a limit switch which can be brought into contact with the pivoting plate while the pivoting plate is elastically pivoted.

5. The apparatus according to claim 2, wherein the arrangement of the driving sprocket and the plurality of driven sprockets corresponds to the arrangement of the bowling pin setting holes to sequentially load the holes with a respective bowling pin.

6. The apparatus according to claim 2, wherein a link of the chain is operably connected to the bowling pin distributing means thus aligning the bowling pin distributing means with a corresponding bowling pin setting hole as the driving means sequentially moves the bowling pin distributing means to each bowling pin setting hole.

7. The apparatus according to claim 2, wherein the distributing means comprises:

a first frame operably connected to an upper part of the bowling pin collecting section allowing the first frame to be rotated leftward and rightward; and a second frame operably coupled to the first frame the second frame sliding on guide rollers extending from the first frame 22 allowing the first frame to be extended forward and retracted backward, whereby an entire length of the first and second frames can be changed.

8. The apparatus according to claim 7, further comprising:

a driving roller driven by a second driving motor installed at a rear end of the first frame;

a fixed tension roller installed at a front end of the second frame;

a driven roller installed at a front end of the second frame;

a movable tension roller installed at a rear end of the second frame and a pair of bowling pin delivering belts wound on the driving roller, driven roller, fixed tension roller and movable tension roller driven by the driving roller operatively coupled to the second driving motor to sequentially convey bowling pins to the bowling pin distributing means.

9. The apparatus according to claim 8, wherein the bowling pins are transported to the bowling pin distributing means as they are directly supported by the pair of bowling pin delivering belts as the belts are driven.

10. The apparatus according to claim 7, further comprising:

a pair of bowling pin distributing arms at the front end of the second frame and fixedly supported by a support shaft, both ends of the support shaft being fixed to a pair of respective pivoting plates, the respective pivoting plates being installed on both side walls of the second frame such that the pivoting plates can be elastically pivoted about a center shaft.

11. The apparatus according to claim 10, wherein respective pivoting plates include a left pivoting plate connected to the left side wall of the second frame via a coil spring, and a right pivoting plate for operable contact with a limit switch upon being pivoted.

12. The apparatus according to claim 11, wherein if the bowling pin distributing arms are pressed downward by a weight of the bowling pin placed thereon, the pivoting plates are elastically pivoted downward about the center shaft to be detached from the limit switch, and if the bowling pin placed on the bowling pin distributing arms is set and sequentially distributed in one of bowling pin setting holes, the pivoting plates are returned to their original position due to an elastic force of the coil spring and brought into contact with the limit switch to interrupt the operation of the first driving motor.

13. The apparatus according to claim 1, wherein only the bowling pins are discharged through a space between the fixed plate and the sloped plate, while only the bowling ball is guided toward a guide groove corresponding to a center of the sloped plate aligned with the inclined guide surface to be pushed upward via a driving wheel to the returning rails.

14. An apparatus for a billiard bowling game comprising:

a bowling pin collection section:

a conveyor to forward only knocked down bowling pins to the bowling pin collection section;

a bowling pin distribution section in communication with the bowling pin collection section, the bowling pin distributing section including:

a bowling pin distributing means for sequentially setting and distributing bowling pins;

a driving means for driving the bowling pin distributing means to transfer respective bowling pins from the bowling pin collecting section, the driving means including a chain wound on a driving sprocket coupled to a first driving motor and a plurality of driven sprockets, ten intermittently spaced-apart projections extending from the chain to interrupt operation of the first driving motor when a projection of the plurality of the projections is brought into contact with a limit switch operably connected to the first driving motor, a first frame rotating leftward or rightward by the chain, a second frame extending forward or retracting backward on guide rolls, a pair of bowling pin delivering belts driven by a second driving motor to deliver respective bowling pins transferred from the bowling pin collecting means, a pair of bowling pin distributing arms elastically pivoted with a pivoting plate to sequentially set and distribute the respective bowling pins in the bowling pin setting holes defined in the bowling pin setting plate, wherein the arrangement of the driving sprocket and the plurality of driven sprockets corresponds to the arrangement of 10 bowling pin setting holes to sequentially load the holes with a respective bowling pin; a base section having bowling pin setting holes defined in a bowling pin setting plate for sequentially receiving bowling pins in respective bowling pin setting holes; and a bowling ball returning section intermediate the base section and the bowling pin collection section, the bowling ball returning section including:

a sloped plate having an inclined guide surface, the sloped plate having a guide groove disposed below a fixed plate defining the base section and positioned above the conveyor;

a pair of side plates fastened to the fixed plate and adjacent to a rear lower end of the base section;

a pair of returning rails extending from an opening in one of the side plates;

a bowling ball-guiding curved plate installed between the pair of side plates;

a driving motor fixedly mounted to one of the side plates; and a driving shaft of the driving motor installed to pass through a center axis of the bowling ball-guiding curved plate having a semi-circular configuration, wherein when a bowling ball is struck and driven by a billiard cue and knocks down at least one of the plurality of bowling pins erected at an end of a bowling lane, the bowling ball is returned to its ready-for-use position through the returning rails and the at least one bowling pin is collected through the bowling pin collecting means.

* * * * *